US008672155B2

(12) United States Patent
Knierbein et al.

(10) Patent No.: US 8,672,155 B2
(45) Date of Patent: Mar. 18, 2014

(54) CLOSURE CAP FOR A CONTAINER FILLED WITH MEDICINAL FLUID, AND CONTAINER HAVING A CLOSURE CAP

(75) Inventors: Bernd Knierbein, Neu-Anspach (DE); Helmut Walter, Darmstadt (DE); Janina Luke, Attendorn (DE); Walter Schulte, Finnentrop (DE); Frank Römer, Finnentrop (DE); Wolfgang Heukamp, Finnentrop (DE)

(73) Assignee: Fresenius Kabi Deutschland GmbH, Bad Homburg V.D.H. (DE)

( * ) Notice: Subject to any disclaimer, the term of this patent is extended or adjusted under 35 U.S.C. 154(b) by 1114 days.

(21) Appl. No.: 12/309,656

(22) PCT Filed: Jul. 26, 2007

(86) PCT No.: PCT/EP2007/006624

§ 371 (c)(1),
(2), (4) Date: Jul. 23, 2009

(87) PCT Pub. No.: WO2008/014919

PCT Pub. Date: Feb. 7, 2008

(65) Prior Publication Data

US 2012/0255952 A1 Oct. 11, 2012

(30) Foreign Application Priority Data

Aug. 1, 2006 (DE) ..... 10 2006 035 761

(51) Int. Cl.
*B65D 41/50* (2006.01)
*B65D 41/34* (2006.01)

(52) U.S. Cl.
USPC ..... 215/228; 215/389; 215/309; 220/267; 220/277; 222/83

(58) Field of Classification Search
USPC ..... 215/253, 388, 228, 307, 309, 389; 220/717, 254.3, 254.5, 277, 267; 222/81, 83
See application file for complete search history.

(56) References Cited

U.S. PATENT DOCUMENTS

| | | | | |
|---|---|---|---|---|
| 3,477,618 | A | 11/1969 | Hazard | |
| 4,531,649 | A | 7/1985 | Shull | |
| 5,961,010 | A | 10/1999 | Smith | |
| 6,139,534 | A * | 10/2000 | Niedospial et al. | 604/411 |
| 6,161,728 | A | 12/2000 | Dark | |

(Continued)

FOREIGN PATENT DOCUMENTS

| | | |
|---|---|---|
| DE | 7509679 U | 10/1975 |
| EP | 0179498 | 4/1986 |

(Continued)

OTHER PUBLICATIONS

International Search Report of PCT/EP2007/006624, date of mailing Jan. 24, 2008.

*Primary Examiner* — Anthony Stashick
*Assistant Examiner* — James N Smalley
(74) *Attorney, Agent, or Firm* — Hamilton, Brook, Smith & Reynolds, P.C.

(57) ABSTRACT

The invention relates to a closure cap for a container filled with medicinal fluid, which container has an aperture piece which is sealed off by a diaphragm which can be punctured. The closure cap has a cap-shaped closure body (1) and a drinking neck (4) with a drinking opening (4*a*) which is pivotable between a first position, in which the drinking neck bears against the closure cap, and a second position, in which the drinking neck projects from the closure cap. In addition, the closure cap has means (20, 22) for puncturing the diaphragm which seals off the aperture piece of the container, which means (20, 22) interact with the drinking neck in such a way that, as the drinking neck (4) is pivoted, the diaphragm is punctured such that a connection is produced between the opening (4*a*) of the drinking neck and the container interior. The closure cap is characterized in that the closure body has, in addition to the opening (4*a*) of the drinking neck (4), an opening (20*a*, 24) for ventilating the container during drinking.

17 Claims, 3 Drawing Sheets

(56) References Cited

U.S. PATENT DOCUMENTS

Figure 3:
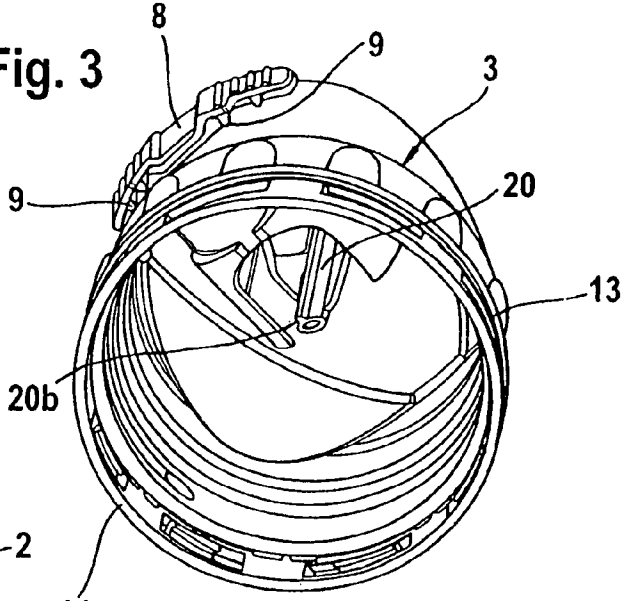

| | | | | |
|---|---|---|---|---|
| 2002/0170930 | A1 | 11/2002 | Elder | |
| 2003/0057176 | A1 | 3/2003 | Kitterman et al. | |
| 2004/0089165 | A1 * | 5/2004 | Seelhofer | 99/516 |

FOREIGN PATENT DOCUMENTS

| | | | |
|---|---|---|---|
| EP | 1 125 854 | A | 8/2001 |
| EP | 1 353 853 | A | 10/2003 |
| FR | 2 789 659 | A | 8/2000 |
| GB | 2311283 | | 9/1997 |
| JP | 2003-182713 | | 7/2003 |
| JP | 2003-529503 | | 10/2003 |
| WO | WO 02/26583 | A | 4/2002 |
| WO | WO 03011699 | | 2/2003 |
| WO | WO 2005/049446 | | 6/2005 |
| WO | WO 2006/057536 | A | 6/2006 |

* cited by examiner

CLOSURE CAP FOR A CONTAINER FILLED WITH MEDICINAL FLUID, AND CONTAINER HAVING A CLOSURE CAP

RELATED APPLICATIONS

This application is the U.S. National Stage of International Application No. PCT/EP2007/006624, filed Jul. 26, 2007, published in German, and claims priority under 35 U.S.C. §119 or 365 to German Application No. 102006035761.2, filed Aug. 1, 2006.

The invention relates to a closure cap for a container filled with a medical liquid, and in particular a liquid for enteric nutrition, which has a mouth section sealed with a piercable membrane. As well as this, the invention also relates to a container for receiving a medical liquid, and in particular an enteric nutrient solution, which has a mouth section sealed with a piercable membrane, the mouth section of the container being closed off by a closure cap of the above kind.

Liquid nutrient solutions for enteric nutrition are available in containers, such for example as bottles or bags. It is known for the medical containers for receiving the enteric nutrient solutions to be filled aseptically. Where it is bottles which are filled, it is also known for the mouth section of the container to be sealed with a membrane, such as an aluminium foil or plastics film for example.

To enable the nutrient-solution containers to be drunken from, what are generally used are drinking straws by which the sealing foil or film is pierced. Alternatively, the sealing foil or film having been pulled off, the contents of the container may also be poured into a drinking vessel. However, there are certain disadvantages to drinking with a straw. In this way, nutrient-solution containers which are opened with straws cannot be closed again, thus creating a risk of the contents being able to spill out as a result of incorrect handling. Also, it is often not easy to drink from non-collapsible containers, such for example as from plastics bottles or from the containers which are also known as Tetra-Paks, because not enough air is supplied to the container. Particularly for people who are debilitated, old and/or sick, it is often no longer possible to pierce the sealing foil or film with a straw or to drink through the straw.

A closure system which has a drinking nozzle (drinking spout) able to be placed upright is known from U.S. Pat. No. 5,961,010. This known closure system does not however have an arrangement for piercing a sealing foil or film. Nor is any provision made for supplying air to the container closed off by the closure system.

EP A 1 125 854 describes a closure cap having a pivotable pouring spout which is in the form of a penetrating spike. When the pouring spout is placed upright, a membrane arranged in the closure cap is pierced. However, this known closure cap is not intended to be screwed onto a container which is already sealed with a sealing foil or film. Instead, the piercable membrane is part of the closure cap. What is more, the known closure cap makes no provision for the supply of air to the container.

Known from FR A 2 789 659 is a closure top, not in the form of a screw cap, which has a pouring spout which, when placed upright, pierces a sealing foil or film. This closure top too makes no provision for supplying the container with air.

U.S. Pat. No. 6,161,728 describes a closure top, having a pouring spout and a cutting device, which can also be used for, for example, foil-sealed or film-sealed drinks bottles. The cutting device is two knives. A disadvantage is that production is relatively complicated and costly. Also, no provision is, once again, made for the supply of air.

Known from EP A 1 353 853 is a closure for containers for liquids and bulk materials which has a pouring spout and cutting means for opening foil-sealed or film-sealed containers. In this case too there is no opening for the supply of air.

WO 2006/057536 describes a foil-sealed or film-sealed bottle having a closure cap which has a drinking spout. Something that once again proves to be a disadvantage is that no provision is made for supplying air to the bottle. This makes handling more difficult, particularly for people who are debilitated.

The object underlying the invention is to provide a closure cap which is easy to handle particularly for debilitated people and with which a container which is filled with liquid, and particularly with an enteric nutrient solution, and which is sealed by a piercable membrane can be closed off. This object is achieved in accordance with the invention by virtue of the features of claim 1. Advantageous embodiments form the subject matter of the dependent claims.

A further object of the invention is to provide a container which is easy to handle and has a closure cap of this kind. This object is achieved by virtue of the features of claim 15.

The closure cap according to the invention has a main closure body in cap form and a drinking nozzle, having an opening for drinking from, which can be pivoted between a first position in which the drinking nozzle rests against the main closure body and a second position in which the drinking nozzle is distant from the main closure body.

What is more, the closure cap has means for piercing the membrane sealing the mouth section of the container, which co-operate with the drinking nozzle in such a way that the membrane is pierced when the drinking nozzle is pivoted, thus causing a connection to be made between the opening in the drinking nozzle and the interior of the container.

The closure cap according to the invention is distinguished by the fact that, as well as the opening in the drinking nozzle for drinking from, the main closure body also has an opening for supplying the container with air when drinking. The means for piercing the membrane co-operate with the drinking nozzle in such a way that, when the drinking nozzle is pivoted, a connection is made not only between the interior of the container and the opening in the drinking nozzle but also between the interior of the container and the opening for supplying air. Because both the connections can be made simply by pivoting the drinking nozzle, handling is simplified.

The invention provides for two alternative embodiments which differ from one another in that, for drinking and the supply of air, the membrane is pierced only at one point or at two points.

In the particularly preferred embodiment of the invention, in which the membrane is pierced only once, the means for piercing the membrane are in the form of a tubular body whose opening is the opening for supplying air. The tubular body is arranged on the main closure body to be pivotable with the drinking nozzle in such a way that, when the drinking nozzle is pivoted, the membrane is pierced by the tubular body, thus causing a connection to be made between both the drinking opening and also the opening for the supply of air, and the interior of the container.

In the alternative embodiment of the invention in which the membrane is pierced at two points, the means for piercing the membrane comprise an additional penetrating spike which, by means of a weakened zone which is provided with the opening for the supply of air, is so arranged in the covering part of the main closure body that the penetrating spike can be pressed against the membrane by pivoting the drinking nozzle. By this means, not only is the connection made between the drinking opening and the interior of the container but an additional connection is also made between the opening for the supply of air and the interior of the container. The opening for the supply of air in the weakened zone is preferably formed by a plurality of perforations of the like which are arranged around the penetrating spike.

The production of the closure cap according to the invention is preferably simplified by making the drinking nozzle an integral part of the main closure body. It is therefore possible for the closure cap to be inexpensively produced in a single-stage production process. For this purpose, the main closure body is preferably weakened in the region of the base part of the drinking nozzle in such a way that the integrally formed drinking nozzle can be pivoted between the first and second positions. To guard against the closure cap being opened unintentionally, the drinking nozzle is secured to the main closure body in the first position, preferably by a tamper-evidencing seal. The tamper-evidencing seal is advantageously a tab which can be pulled off the main closure body and which engages over a projection projecting from the drinking nozzle. Thus, to open the closure cap, the tab simply has to be pulled off and the drinking nozzle placed upright. It is however also possible for the drinking nozzle to be connected to the main closure body in the first position via a weakened zone which tears open when the nozzle is placed upright.

In another preferred embodiment of the closure cap according to the invention, provision is made for the drinking nozzle to be arranged in a recess or depression in the covering part of the main closure body in the first position. This means that the drinking nozzle does not disrupt the smooth appearance. The drinking nozzle is preferably fixed in place in the recess by latching in.

To allow the closure cap to be screwed onto a container employing a screwed closure, the skirt part of the main closure body preferably has a portion having an inside thread. However, the closure cap need not necessarily take the form of a screwed cap.

Because the piercable membrane is a part not of the closure cap but of the container, only limited use can be made of a conventional sealing ridge, which is generally inserted between the closure cap and the mouth section of the container, to seal the closure cap in relation to the container. In the closure cap according to the invention, the seal is made instead by means of a cylindrical sealing face on the inside of the skirt part of the closure cap. When the closure cap is fitted on, this cylindrical sealing face comes to bear, with a seal, against a cylindrical sealing face on the outside of the mouth section of the container.

Whereas the closure cap according to the invention is preferably an injection moulding made of plastics material, and in particular of polypropylene or polyethylene, the container is preferably produced by the injection blow moulding process. The nature of the process means that, compared with extrusion blow moulded containers, production of the container by the injection blow moulding process allows the tolerances to be tighter, which means that the pre-loadings at the sealing faces can be set exactly. This allows lower pre-loadings to be employed at the sealing faces and this means that torques which are reasonable for debilitated persons can be kept to without the sealing action being lost. This type of sealing, which is only possible as a result of injection blow moulded containers, does not require any additional sealing elements or any additional process steps. Basically, it is however also possible for the container to be produced by the extrusion blow moulding process and for it to be, for example, an extrusion blow moulded bottle.

Basically, it is however also possible for a seal to be provided between the closure cap and the top edge of the membrane. Solutions for sealing in relation to a sealing foil or film are described in, for example, WO2005049446, GB 2311283, WO 03011699, US 2003/0057176, EP 0179498 and U.S. Pat. No. 4,531,649. These printed publications propose sealing lips, sealing ribs, or the like being pressed against the collar on the thread by the applying force produced by the screwing-on. The sealing elements are generally composed of a soft polymeric material in this case, which is able to seal against the threaded neck, the roughness of whose surface is relatively great.

In a particularly preferred embodiment, the skirt part of the main closure body has a tamper-evidencing seal which is preferably a locking ring which is integrally moulded onto on upper portion of the skirt part via a weakened zone. If the locking ring has been pulled away from the main closure body, it can be seen that the closure cap has been removed from the container.

Two embodiments of the invention will be explained in detail below by reference to the drawings.

Figure 2:
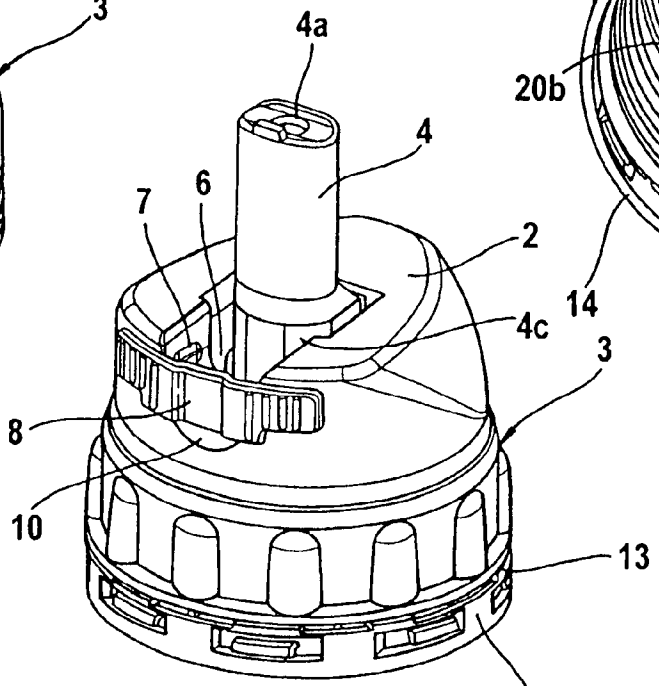
Figure 1:
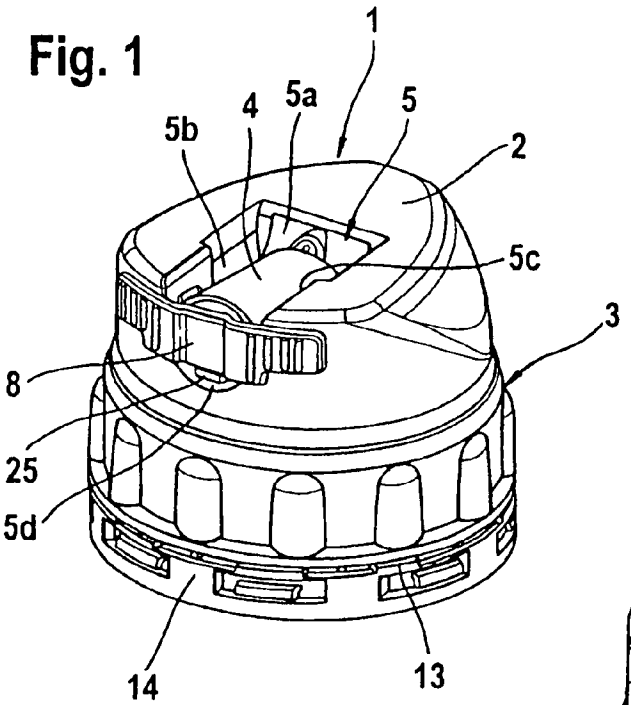
Figures 4, 5, 6:
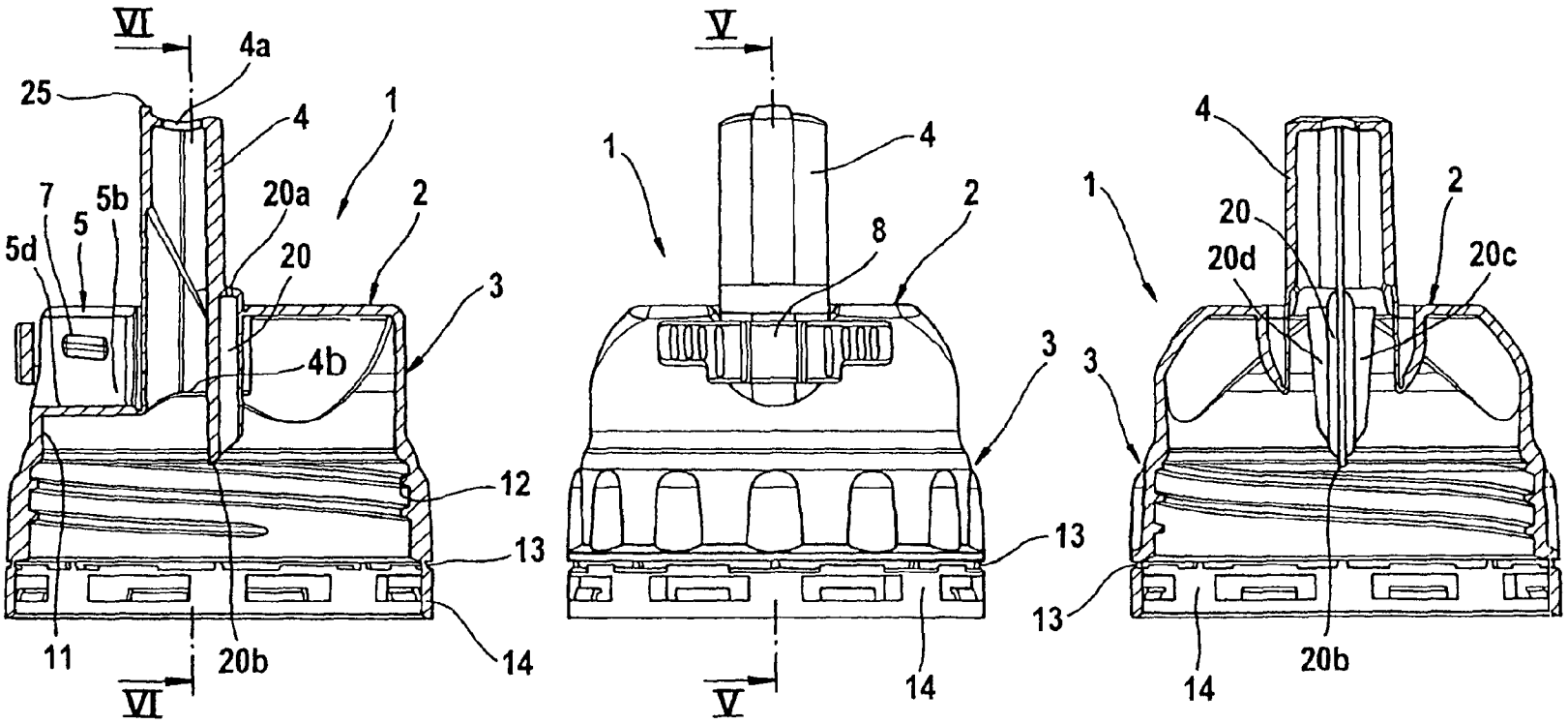
Figure 7:
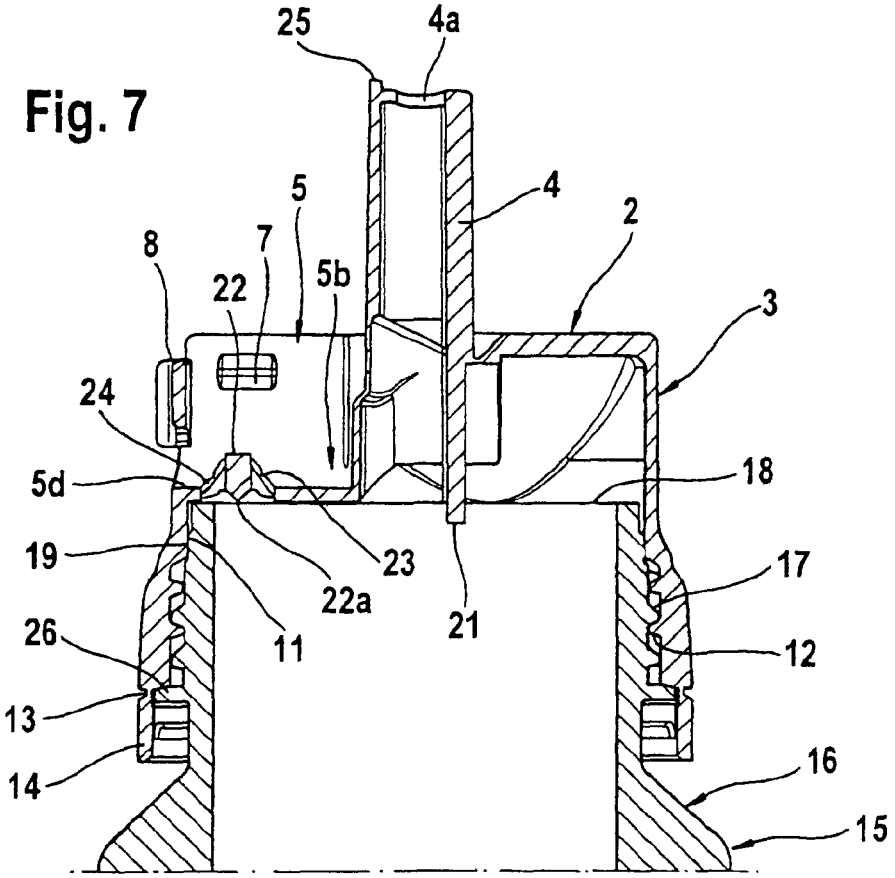
Figure 8:
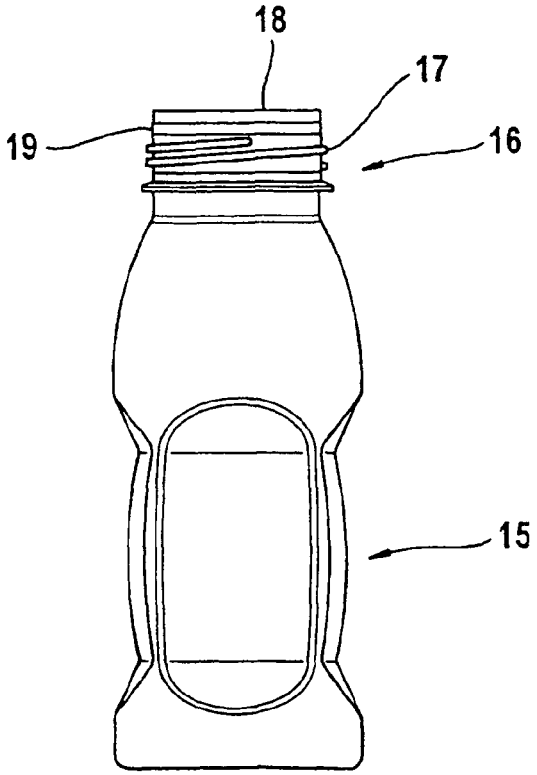

In the drawings:

FIG. 1 is a perspective view of a first embodiment of closure cap according to the invention, before the drinking nozzle is placed upright, FIG. 2 is a perspective view of the closure cap according to the invention shown in FIG. 1, after the drinking nozzle has been placed upright, FIG. 3 is a perspective view of the closure cap of FIG. 1 from below, FIG. 4 is a view of the closure cap according to the invention from the side, FIG. 5 is a section through the closure cap of FIG. 4 on line V-V, FIG. 6 is a section through the closure cap of FIG. 5 on line VI-VI, FIG. 7 is a view in section of a second embodiment of closure cap according to the invention, and FIG. 8 is a view of the container from the side, without a closure cap.

There will be described below, by reference to FIGS. 1 to 6, a preferred embodiment of closure cap according to the invention which is in the form of a screw cap and which is screwed onto a bottle employing a screw closure. The bottle employing a screw closure is shown in FIG. 8.

The closure cap is an injection moulding of plastics material made of polypropylene or polyethylene. The closure cap has a cap-shaped main body 1, having a covering part 2 and a substantially cylindrical skirt part 3. Integrally moulded on the main closure body 1 is a drinking nozzle 4 which can be pivoted from a first position in which the drinking nozzle rests against the main closure body 1 (FIG. 1) to a second position in which the drinking nozzle is distant from the main closure body (FIG. 2). The drinking nozzle 4 can be pivoted through 90° on the main closure body.

The covering part 2 of the main closure body 1 has a recess 5 having a central side-portion 5*a*, two outwardly extending side-portions 5*b*, 5*c* which are situated opposite one another, and a floor portion 5*d*. The drinking nozzle 4 is integrally moulded on the floor portion 5*d* of the recess 5.

The drinking nozzle 4 is a tubular body having an opening 4*a* for drinking from at the top end and an opening 4*b* in the floor portion 5*b* of the depression 5. The drinking nozzle is oval in cross-section to enable the mouth to fit round the nozzle easily. The dimensions of the depression 5 substantially correspond to those of the drinking nozzle 4, thus enabling the drinking nozzle to be pivoted into the recess 5 without projecting beyond it upwards or sideways.

The one-piece closure cap is injection moulded with the drinking nozzle 4 upright. Immediately after the injection moulding, the upright drinking nozzle 4 is bent down through 90° so that the said drinking nozzle rests in the recess. What allows this to happen is a weakening of the material in the region of the base part 4*c* of the drinking nozzle, thus producing a weakened zone 6 surrounding the base part of the drinking nozzle. Whereas the covering part of the main closure body is bent in the region adjacent the depression 5 when the drinking nozzle is pivoted, the region of the covering part in the region situated opposite is stretched. This deformation of the material occurs naturally when the drinking nozzle is bent down, assuming the material is of a suitable thickness and its properties are appropriate.

Integrally moulded into the opposing side faces 5*b* and 5*c* of the depression 5 are two opposing projections 7 which secure the drinking nozzle 4 in the depression. It is secured in place in an additional way by a tamper-evidencing seal 8 on the side of the closure cap.

The tamper-evidencing seal 8 is a plastics tab which is integrally moulded into two sides of the top portion of the skirt part 3 of the main closure body 1 via weakened zones 9. The pull-off tab 8 partly closes off the opening 10 at one end of the depression 5. Below the pull-off tab 8, the drinking nozzle 4 has a projection 25 which engages under the pull-off tab 8.

To place the drinking nozzle 4 upright, the pull-off tab 8 is pulled off, at which time the weakened zones 9 are pulled apart. The drinking nozzle 4, which is fixed in the depression 5 by latching interengagement, is then placed upright, the material of the main closure body deforming in the region of the base part of the nozzle when this is done.

Below the floor portion 5*d* of the depression 5, the skirt part 3 of the main closure body 1 has, on the inside, a cylindrical sealing face 11, at which the closure cap makes a seal with a corresponding cylindrical sealing face on the outside of the mouth section of the container. This sealing will be described in detail by reference to the second embodiment.

Below the cylindrical sealing face 11 is situated, on the inside of the covering part 3, an inside thread 12 of a pitch which corresponds to the pitch of the outside thread on the mouth section of the container.

Below the inside thread 12, there is integrally moulded onto the top portion of the skirt part 3, via a weakened zone 13 extending round in a circle, a locking ring 14. The annular locking ring forms a further tamper-evidencing seal 13, 14 which secures the closure cap on the mouth section of the container. This too will be described in detail by reference to the second embodiment.

FIG. 8 shows the container, which is a bottle produced by the injection blow moulding process which is aseptically filled with an enteric nutrient solution. The bottle (preform) is produced in two stages of operation and has a blown main body 15 having an injection-moulded mouth section 16. After the container has been filled, the mouth section 16, which has an outside thread 17, is sealed with a piercable membrane 18, such for example as an aluminium foil. The purpose of the aluminium foil is to close off the container with a seal which is virtually gas-tight (is a barrier) and aseptic. Above the outside thread 17, the mouth section 16 has, on the outside, a cylindrical sealing face 19 which, when the closure cap is screwed on, comes to bear, with a seal, against the cylindrical sealing face 11 in the skirt part 3 of the main closure body 1.

As a result of the injection blow moulding process, the tolerances which can be met in the region of the outer sealing face 19 of the mouth section are very small, being for example of values which go down to +/−0.1 mm, thus enabling a low, but adequate, pre-loading to be kept to at the sealing faces 11, 19.

The top sides of the closure caps and the bottom parts of the bottles are so formed that the closed bottles can be stacked on top of one another and can thus be stored and transported packed at a greater density.

The principle of operation of the closure cap according to the invention will be described in detail below.

Integrally moulded onto the drinking nozzle 4 of the closure cap in the region of the base part 4*c* thereof is a tubular body 20 which extends on the one hand upwards beyond the covering part 2 of the main closure body 1 and on the other hand downwards beyond the floor portion 5*d* of the depression 5. At its top end, the tubular body 20 has an opening 20*a* for the supply of air and at its bottom end it is provided with a cutting edge or a spike 20*b*. The tubular body is also provided with two lateral ribs 20*c*, 20*d* which extend for the entire length of the tubular body. The two ribs 20*c*, 20*d* form additional aids for breaking open.

The length of the tubular body 20 is sized to be such that, when the drinking nozzle 4 is placed upright, its pointed end 20*b* pierces the membrane 19 on the container when the closure cap is screwed onto the container.

The container filled with enteric nutrient solution is generally delivered with a closure cap screwed on, in which case the drinking nozzle 4 is situated within the depression 5. For nutrient solution to be extracted, the pull-off tab 8 is pulled off and the drinking nozzle 4 is placed upright. As the drinking nozzle is being placed upright, the tubular body 20 which is integrally moulded onto the drinking nozzle pierces the membrane 18 by which the mouth section 16 of the container is sealed. With its pointed end 20*b* and the two lateral ribs, the tubular body cuts a slit of adequate width in the membrane, thus connecting the drinking nozzle and the tubular body to the interior of the container. Because there is an adequate supply of air to the container, the container generally empties by itself, air flowing through the opening 20*a* for the supply of air and via the tubular body 20 into the interior of the container. In the case of very viscous liquids, it may however be necessary for the emptying to be assisted by sucking on the drinking nozzle (drinking spout) and/or pressing the container.

Basically, it is also possible, once the tamper-evidencing seal 13, 14 has been released, for the closure cap according to the invention to be unscrewed, thus exposing the piercable membrane. The membrane can then either be removed or pierced to enable the nutrient solution to be drunk with a straw or transferred to a glass.

An alternative embodiment of the invention will be described below by reference to FIG. 7. The alternative embodiment differs from that which was described by reference to FIGS. 1 to 6 merely in the way in which air is supplied. Otherwise, the two closure caps are of the same construction. For this reason, the parts which correspond to one another are also given the same reference numerals.

The alternative embodiment does not have the tubular body 20 for piercing the membrane to open it. In this embodiment, the bottom portion of the drinking nozzle 4 itself is in the form of a cutting edge 21 and this cutting edge 21 pierces the membrane 18 on the container, and makes the connection for liquid to the interior of the container, when the nozzle is placed upright.

In the alternative embodiment, the supply of air to the container takes place via an additional air-supply opening. For this purpose, a penetrating spike 22, the point 22*a* of which is situated directly above the piercable membrane when the closure cap is screwed on, is integrally moulded into the floor portion 5*d* of the depression 5 in the covering part 2 of the main closure body 1.

When the drinking nozzle 4 is situated in the depression 5, the top edge 22*b* of the penetrating spike 22 rests against the underside of the drinking nozzle. The drinking nozzle is first pressed downwards slightly from the horizontal position, whereby the penetrating spike 22 is pressed downwards likewise and the piercable membrane 18 is pierced. The drinking nozzle 4 is then placed upright, whereby its pointed end 21 makes another piercing in the membrane 18 at a different point.

The weakened zone 23 which connects the penetrating spike 22 to the covering part 2 of the main closure body 1 is in the form of a grid-like structure having a plurality of perforations 24 which act as air-supply openings, thus enabling air to flow into the interior of the container while enteric nutrient solution is able to flow out of the interior of the container through the drinking nozzle.

As well as the closure cap, FIG. 7 also shows the mouth section 16 of the container shown in FIG. 8. The way in which the two sealing faces 11, 19 belonging respectively to the main closure body and the container bear against one another can be seen in FIG. 7. What can also be seen is that the securing ring 14 engages under a projection 26 which extends round in a circle on the mouth section of the container 16 below the outside thread 17.

The invention claimed is:

1. A closure cap, for a container filled with a medical liquid which has a mouth section sealed with a pierceable membrane, having a main closure body in cap form which has a covering part and a skirt part, a drinking nozzle, having an opening for drinking from, which can be pivoted between a first position in which the drinking nozzle rests against the main closure body and a second position in which the drinking nozzle is distant from the main closure body, a tubular body for piercing the membrane which co-operates with the drinking nozzle in such a way that the membrane is pierced when the drinking nozzle is pivoted, thus causing a connection to be made between the opening in the drinking nozzle and the interior of the container, the drinking nozzle extending outwards beyond the tubular body, the tubular body having at its top end an opening for supplying air to the container when drinking and having at its bottom end a cutting edge, the tubular body being arranged on the main closure body to be pivotable with the drinking nozzle in such a way that, when the drinking nozzle is pivoted, the membrane is pierced by the cutting edge of the tubular body, thus causing a connection to be made between the interior of the container and both the drinking opening and the opening for supplying air.

2. The closure cap according to claim 1, wherein the drinking nozzle is an integral one-piece part of the main closure body.

3. The closure cap according to claim 1, wherein the main closure body is weakened in the region of the base part of the drinking nozzle in such a way that the drinking nozzle can be pivoted between the first and second positions.

4. The closure cap according to claim 1, wherein the drinking nozzle is secured to the main closure body in the first position by a tamper-evidencing seal.

5. The closure cap according to claim 4, wherein the tamper-evidencing seal is a tab which can be pulled off the main closure body and which engages over a projection projecting from the drinking nozzle.

6. The closure cap according to claim 1, wherein the covering part of the main closure body has a depression to receive the drinking nozzle in the first position.

7. The closure cap according to claim 6, wherein the drinking nozzle is fixed in place in the depression by latching in.

8. The closure cap according to claim 1, wherein the skirt part of the main closure body has a portion having an inside thread.

9. The closure cap according to claim 1, wherein the skirt part of the main closure body has a cylindrical sealing face on the inside.

10. The closure cap according to claim 1, wherein the skirt part of the main closure body has a tamper-evidencing locking part.

11. The closure cap according to claim 10, wherein the tamper-evidencing seal is a locking ring which is integrally moulded onto the upper portion of the skirt part via a weakened zone.

12. The closure cap according to claim 1, wherein the closure cap is an injection moulding made of plastics materials, and preferably of polypropylene or polyethylene.

13. A container, for receiving a medical liquid, which has a mouth section sealed with a piercable membrane wherein the mouth section of the container is closed off by a closure cap according to claim 1.

14. The container according to claim 13, wherein the container is a container produced by the injection blow moulding process.

15. The container according to claim 13, wherein the container is a bottle.

16. The container according to claim 13, wherein the mouth section of the container has, on the outside, a cylindrical sealing face against which the inner cylindrical sealing face in the sealing cap rests with a seal.

17. The closure cap according to claim 1, wherein the tubular body includes one or more lateral ribs extending a length of the tubular body which aid action of the cutting edge or spike to pierce the membrane when the drinking nozzle is pivoted.

* * * * *

UNITED STATES PATENT AND TRADEMARK OFFICE

CERTIFICATE OF CORRECTION

PATENT NO. : 8,672,155 B2
APPLICATION NO. : 12/309656
DATED : March 18, 2014
INVENTOR(S) : Knierbein et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1407 days.

Signed and Sealed this
Twenty-ninth Day of September, 2015

Michelle K. Lee

Michelle K. Lee
*Director of the United States Patent and Trademark Office*